US010016667B2

(12) United States Patent
Van Nguyen et al.

(10) Patent No.: US 10,016,667 B2
(45) Date of Patent: Jul. 10, 2018

(54) BASEBALL/SOFTBALL BAT WITH SHOCK DISSIPATION CHARACTERISTICS AND METHOD OF MANUFACTURING SAME

(71) Applicant: Xiamen Pheasant Hi-Tech Aluminum Co., Ltd., Xiamen, Fujian (CN)

(72) Inventors: Thu Van Nguyen, West Hills, CA (US); Renqin Zhang, Houxi (CN); Chi-Hung Lee, Houxi (CN)

(73) Assignee: Xiamen Pheasant Hi-Tech Aluminum Co., Ltd., Fujian (CN)

( * ) Notice: Subject to any disclaimer, the term of this patent is extended or adjusted under 35 U.S.C. 154(b) by 0 days.

(21) Appl. No.: 15/714,670

(22) Filed: Sep. 25, 2017

(65) Prior Publication Data

US 2018/0015342 A1 Jan. 18, 2018

Related U.S. Application Data

(63) Continuation-in-part of application No. 14/584,078, filed on Dec. 29, 2014.

(51) Int. Cl.

| | |
|---|---|
| ***A63B 59/00*** | (2015.01) |
| ***A63B 60/54*** | (2015.01) |
| ***A63B 59/51*** | (2015.01) |
| ***A63B 60/14*** | (2015.01) |
| ***A63B 60/08*** | (2015.01) |
| *A63B 102/18* | (2015.01) |

(52) U.S. Cl.

CPC ..... *A63B 60/54* (2015.10); *A63B 59/51* (2015.10); *A63B 60/08* (2015.10); *A63B 60/14* (2015.10); *A63B 2102/182* (2015.10); *A63B 2209/00* (2013.01)

(58) Field of Classification Search

CPC ..... A63B 59/06; A63B 59/00; A63B 69/00
USPC ..... 473/457, 520, 564, 566, 567
See application file for complete search history.

(56) References Cited

U.S. PATENT DOCUMENTS

| | | | |
|---|---|---|---|
| 4,951,948 | A | 8/1990 | Peng |
| D476,409 | S | 7/2003 | Van Nguyen |
| 6,808,464 | B1 | 10/2004 | Van Nguyen |
| 6,820,654 | B2 | 11/2004 | Lindsay |
| 6,896,006 | B2 | 5/2005 | Lindsay |
| 7,014,580 | B2 | 3/2006 | Forsythe |
| 7,052,419 | B2 | 5/2006 | Chang |
| 7,166,046 | B1 | 1/2007 | Liu |
| 7,201,679 | B2 | 4/2007 | Van Nguyen |
| 7,207,354 | B2 | 4/2007 | Lindsay |
| 7,311,620 | B1 | 12/2007 | Heald |
| 7,314,067 | B2 | 1/2008 | Lindsay |
| 7,328,599 | B2 | 2/2008 | Van Nguyen |
| 7,344,461 | B2 | 3/2008 | Van Nguyen |
| 7,377,866 | B2 | 5/2008 | Van Nguyen |
| 7,381,141 | B2 | 6/2008 | Van Nguyen |

(Continued)

*Primary Examiner* — Gene Kim
*Assistant Examiner* — Christopher Glenn
(74) *Attorney, Agent, or Firm* — Kelly & Kelley, LLP

(57) ABSTRACT

A barrel of a baseball or softball bat is coupled to an end of a handle of the bat by means of a vibration absorber affixed to the end of the handle. Projections of a first locking section of the vibration absorber engage with depressions formed on an inner surface of the barrel. Adhesive disposed within gaps and channels of the vibration absorber adhere the vibration absorber to the barrel. A second locking section of the vibration absorber is attachable to a sleeve disposed over the handle. The sleeve may be of a material having shock absorbing or dissipating characteristics.

21 Claims, 8 Drawing Sheets

(56) References Cited

U.S. PATENT DOCUMENTS

| | | | |
|---|---|---|---|
| 7,475,705 | B2 | 1/2009 | Lindsay |
| 2005/0196570 | A1 | 9/2005 | Lindsay |
| 2008/0058132 | A1 | 3/2008 | Van Nguyen |
| 2011/0098141 | A1 | 4/2011 | Burger |

BASEBALL/SOFTBALL BAT WITH SHOCK DISSIPATION CHARACTERISTICS AND METHOD OF MANUFACTURING SAME

RELATED APPLICATIONS

This is a continuation-in-part of U.S. application Ser. No. 14/584,078, filed Dec. 29, 2014.

BACKGROUND OF THE INVENTION

The present invention relates to baseball and softball bats. More particularly, the present invention relates to a multi-component bat having shock dissipation characteristics.

Baseball and softball are very popular sports in the United States, Mexico, Cuba, Japan and elsewhere. Due to the competitive nature of these sports, players are constantly seeking ways of improving their performance. An important aspect of baseball and softball is the ability to effectively hit the ball.

Metal, such as aluminum alloy, and composite material bats are allowed in baseball amateur play from Little League to college levels. Such bats are also typically used in slow- and fast-pitch softball. Metal and composite bats are advantageous over wood bats in that they do not break and splinter like wood bats and thus can be repeatedly used with consequent cost savings. Metal and composite bats also have a larger optimal hitting area or power zone than wood bats. Further, the ball comes off a metal or composite bat faster than a wood bat, resulting in longer hits.

However, these bats have certain disadvantages. Bats comprised of metal, composite materials and combinations thereof vibrate upon impact. The shock caused by the bat hitting a ball may send painful vibrations into the hands and arms of the batter if the ball is not hit at the sweet spot of the bat. Various attempts have been made to overcome the vibration problems associated with metal and composite material bats.

Attempts to create multi-component bats, particularly those having vibration dissipating or absorbing characteristics, have often been complicated in nature in assembling and formation. Oftentimes, the interconnection points between the various components of the bat, such as the handle and barrel, are prone to failure as the bat is used repeatedly, causing connecting points and internal devices to break over time. The joint or connection between the handle and the bat barrel is especially prone to failure. Also, many of the designs do not effectively dampen the vibrations caused when the bat hits an object, such as a baseball or softball.

Accordingly, there is a continuing need for a bat which is not complex in design and is not expensive to manufacture and not prone to structural failure. Moreover, a bat is needed which effectively dissipates vibrations and shock caused when hitting an object, such as a baseball or softball. The present invention fulfills these needs, and provides other related advantages.

SUMMARY OF THE INVENTION

The present invention resides in a baseball or softball bat having shock dissipating properties and characteristics. The bat of the present invention is a multi-component bat which is relatively simple in design and not expensive to manufacture and not prone to structural failure while providing vibration and shock dissipating and absorbing characteristics to enhance the use of the bat.

The baseball or softball bat generally comprises a barrel having a distal end and a proximal end. A handle has a first end defining a grip portion adjacent to a first end and a second end which is disposed within the proximal end of the barrel. The barrel and the handle may be comprised of a composite material.

A vibration absorber is affixed to the second end of the handle. The vibration absorber is typically comprised of a shock absorbing material, such as an elastomeric material. The material may be molded onto the second end of the handle. The elastomeric material of the vibration absorber and the material of the handle may be fused to one another as the vibration absorber is molded onto the handle.

The vibration absorber defines a first locking section and a second locking section spaced apart from the first locking section and a circumferential gap disposed between the first and second locking sections. An adhesive is disposed in the circumferential gap for adhering the vibration absorber to the barrel. The adhesive may comprise a polymeric material having shock absorbing characteristics.

The first locking section of the vibration absorber has projections which engage with depressions formed on an inner surface of the barrel adjacent the proximal end thereof. The projections may comprise threads that are threadedly attached to threads formed on an inner surface of the bat barrel. A channel may be formed through the threads of the first locking section generally along the longitudinal axis of the handle. Adhesive is disposed within the channel to adhere the vibration absorber to the barrel. The adhesive in the channel may be comprised of a polymeric material having shock absorbing characteristics.

The second locking section also defines projections. A sleeve is disposed over the handle and has depressions formed on an inner surface at an end thereof that engage the projections of the second locking section. The projections of the second locking section may comprise threads that are threadedly attached to the depressions, also forming threads, formed in the inner surface of the sleeve. The second locking section of the vibration absorber may extend outward of the proximal end of the barrel. The sleeve may be comprised of a translucent or transparent material so that the connection between the sleeve and the second locking section is viewable.

The sleeve may be comprised of silicone rubber or other vibration dampening or absorbing material, such as silicone rubber. A grip may be placed over the grip portion of the handle and over at least a portion of the sleeve. The first end of the handle may have a knob attached thereto and the distal end of the barrel may include a cap or plug.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a multi-component baseball or softball bat, generally referred to by the reference number 10, as well as a method for manufacturing the same. The baseball bat 10 has vibration absorbing and shock dissipating characteristics. The bat 10 also has an enlarged hitting zone and sound control.

Figure 1:
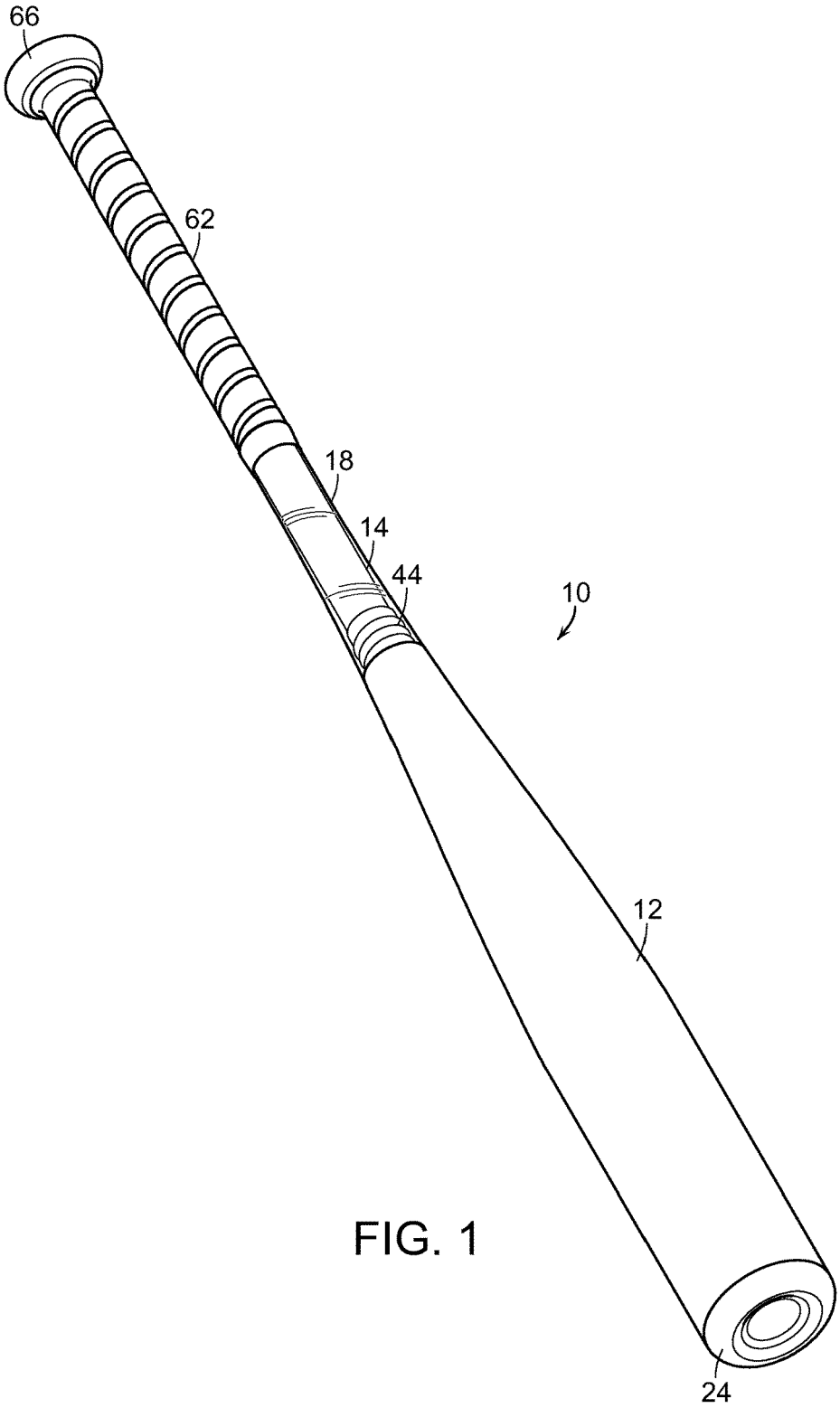
FIG. 1 is a perspective view of a baseball or softball bat embodying the present invention.
Figure 2:
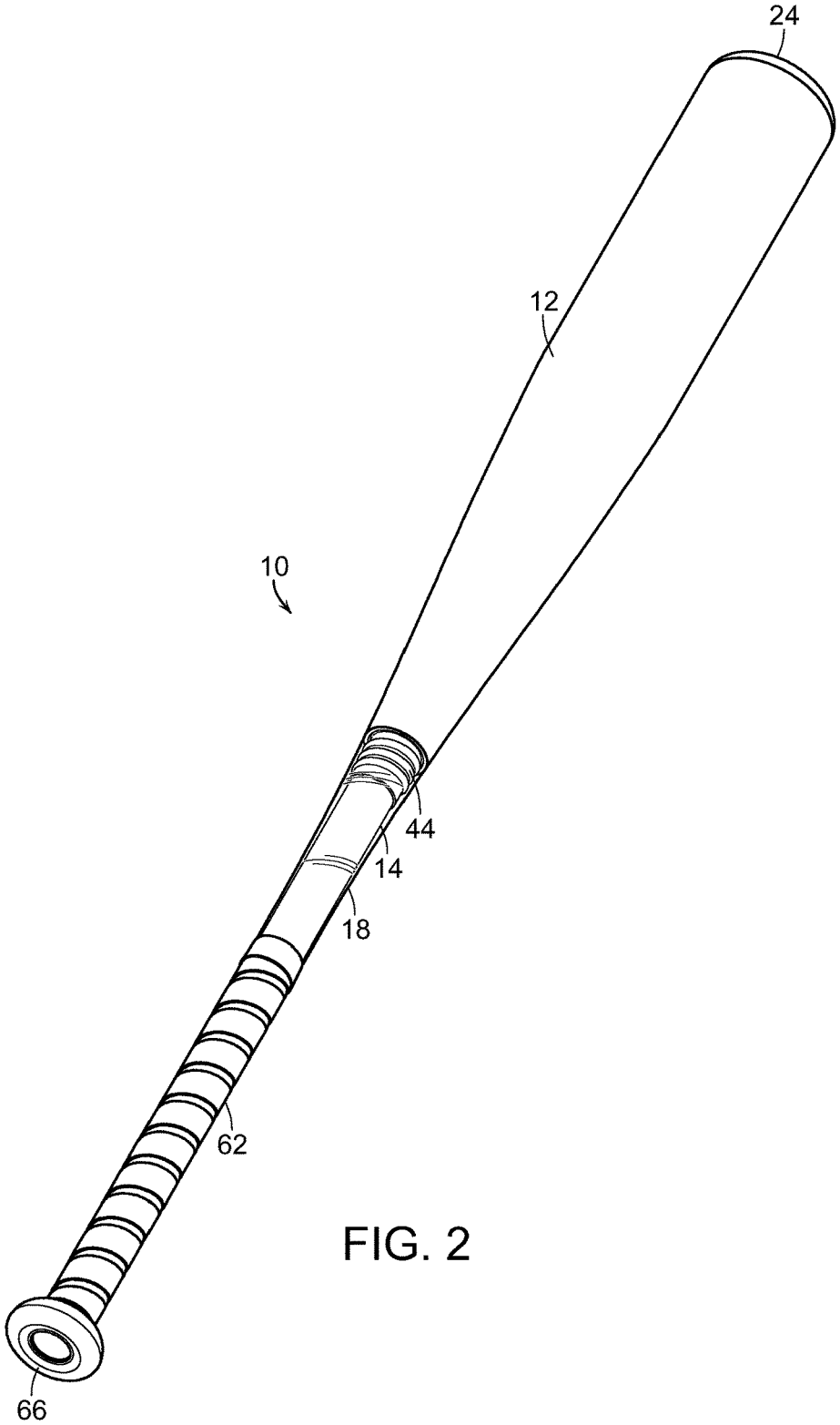
FIG. 2 is another perspective view of the bat of the present invention.
Figure 3:
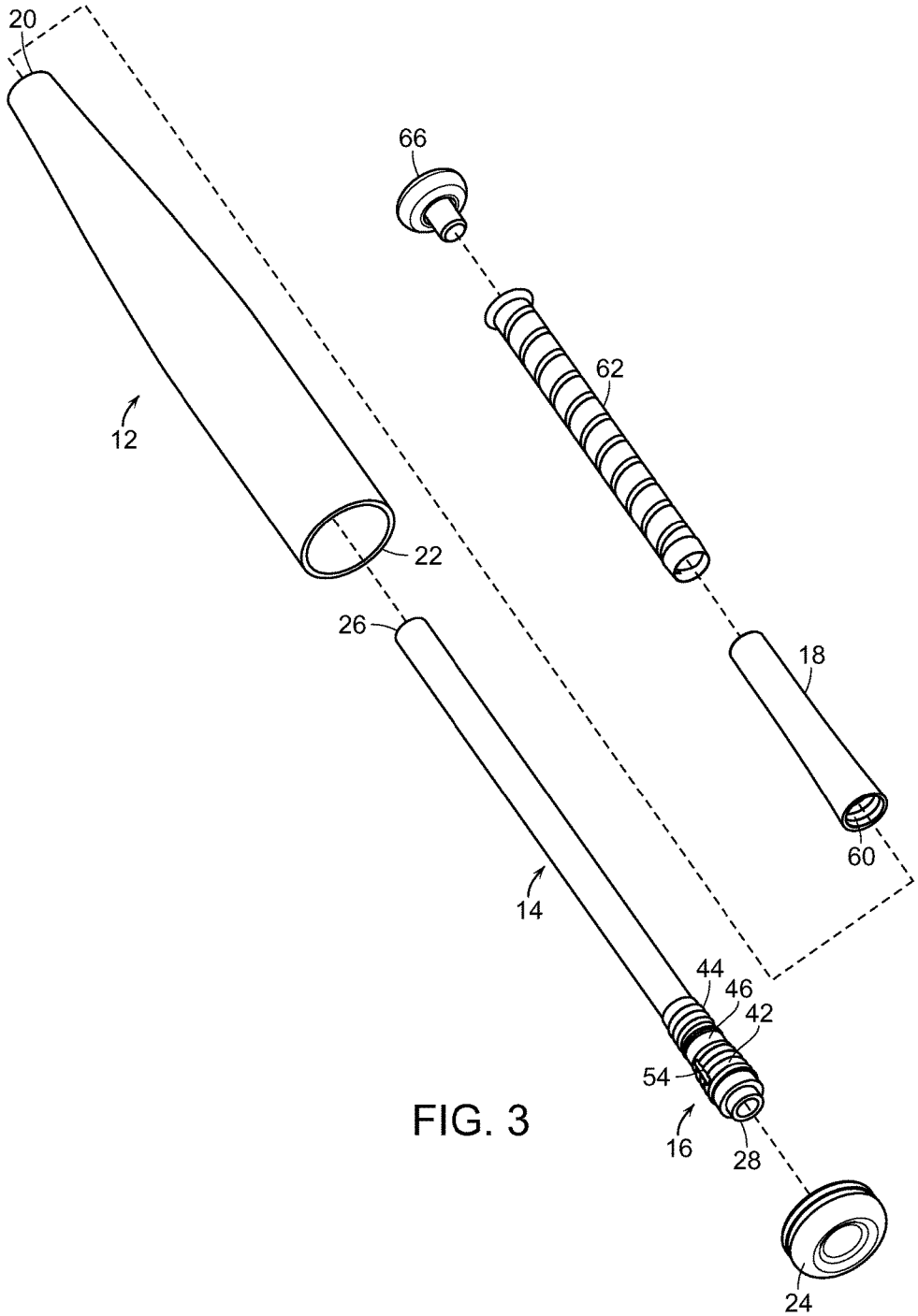
FIG. 3 is an exploded perspective view of component parts of the bat of the present invention.

With reference now to FIGS. 1-3, a bat 10 embodying the present invention is illustrated. The bat 10 is generally comprised of a barrel 12, a handle 14, a vibration absorber 16 affixed to the handle 14 and attachable to the barrel 12, and a sleeve 18 which is connected to the vibration absorber 16 and is disposed over at least a portion of the handle 14. The incorporation of the vibration absorber 16 and the design of the barrel 12 provides an enlarged hitting zone or "sweet spot" of the bat 10 and also provides sound control. As will be more fully discussed herein, the handle 14, via the vibration absorber 16, is attached or locked to the barrel 12 securely by two different means. Moreover, multiple components and aspects of the bat 10 provide vibration and shock dissipation and absorption when the bat 10 hits an object, such as a ball.

With continuing reference to FIGS. 1-3, the barrel 12 is typically comprised of metal, such as aluminum or an aluminum alloy, or a laminate composite material, such as composite fibers or sheets which may be pre-impregnated with resins and the like. Typically, the barrel 12 is generally hollow. The barrel has a proximal end 20 which is typically tapered inwardly, as shown. At a generally opposite end of the barrel 12 is the distal end 22. The distal end 22 may have a cap or plug 24 or the like attached thereto so as to close the open distal end 22 of the barrel 12. Alternatively, the distal end 22 of the barrel 12 may be closed in upon itself so as to close the distal end 22, as is known in the art. However, the distal end 22 of the barrel 12 is not closed until the handle 14 has been inserted therethrough for connection to the barrel 12, as will be more fully described herein.

The handle 14 may be comprised of composite material, such as composite fibers or sheets which may be pre-impregnated with resins and the like. The handle 14 may be generally cylindrical and hollow, as illustrated. The handle 14 may be of generally uniform width along a length thereof. The handle 14 has a first end 26 defining a grip portion of the handle 14. The vibration absorber 16 is typically attached to a generally opposite second end 28 of the handle 14. The composition and design of the handle 14 provide a desired degree of flexibility while remaining durable.

Figure 4:
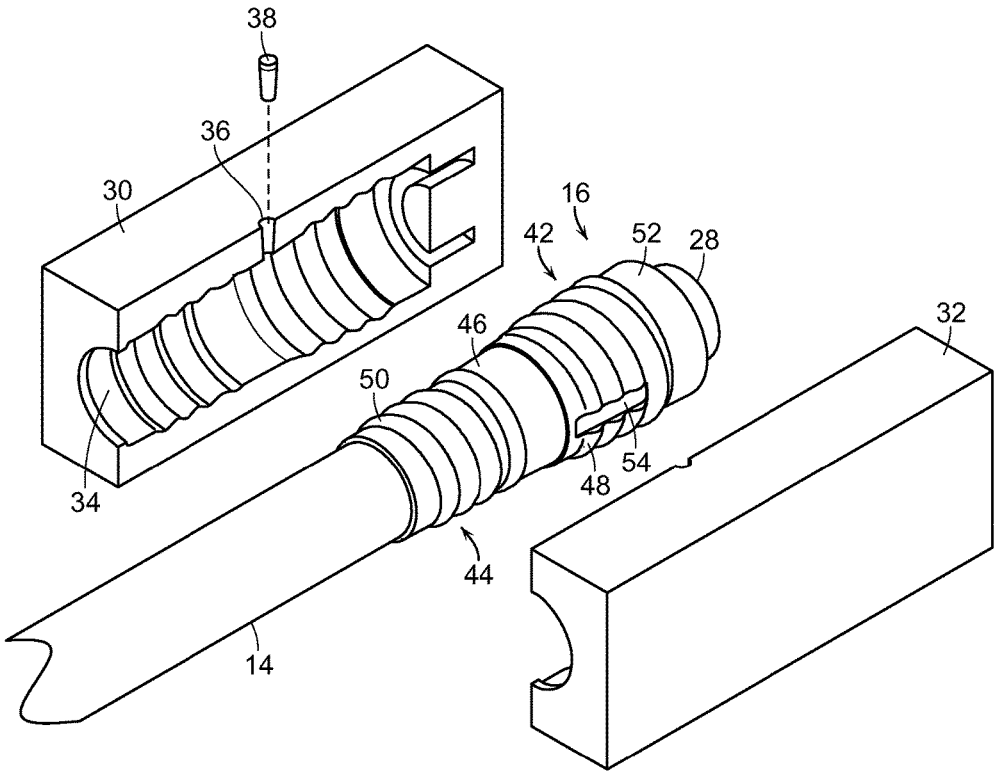
FIG. 4 is a perspective view of a mold that molds a vibration absorber onto an end of the handle of the bat, in accordance with the present invention.

With reference now to FIG. 4, the vibration absorber 16 can be attached to the handle 14 by various means. However, the connection points of the components of multi-component bats in the past have been prone to failure as the adhesive or mechanical attachments break over time due to the repeated hitting of a ball or other object by the bat. Accordingly, in a particularly preferred embodiment, as illustrated in FIG. 4, the vibration absorber 16 is molded onto the handle 14. Mold members 30 and 32 cooperatively define an inner cavity 34 defining the configuration of the vibration absorber 16. An aperture 36 may receive an injection needle 38 for injecting the material forming the vibration absorber 16 into the joined mold members 30 and 32, which surround the end 28 of the handle 14 so as to mold the vibration absorber 16 onto the handle 14.

The vibration absorber 16 is comprised of a material having vibration dampening and dissipating characteristics. For example, the vibration absorber may be comprised of an elastomeric material, such as an elastic polymer material having a desired hardness so as to be physically attached to the barrel 12 of the bat while still providing flexibility and vibration dampening and absorbing characteristics. For example, the elastic polymer material may have a durometer hardness of between 25-100 shore A.

The mold members 30 and 32 may be comprised of metal, such as steel, which is preheated to approximately 60° C. The melted, liquid elastic polymer material is injected into the mold to form the vibration absorber 16 directly onto the surface of the handle 14. The newly injected elastic polymer material may be cured at approximately 140° C. under pressure of approximately 70 Mpa for approximately ten to twenty minutes. The temperature of the mold may then be reduced to approximately 60° C. and mold members 30 and 32 removed from the handle 14 resulting in the newly formed vibration absorber 16 molded thereon, as illustrated in FIG. 4.

Figure 5:
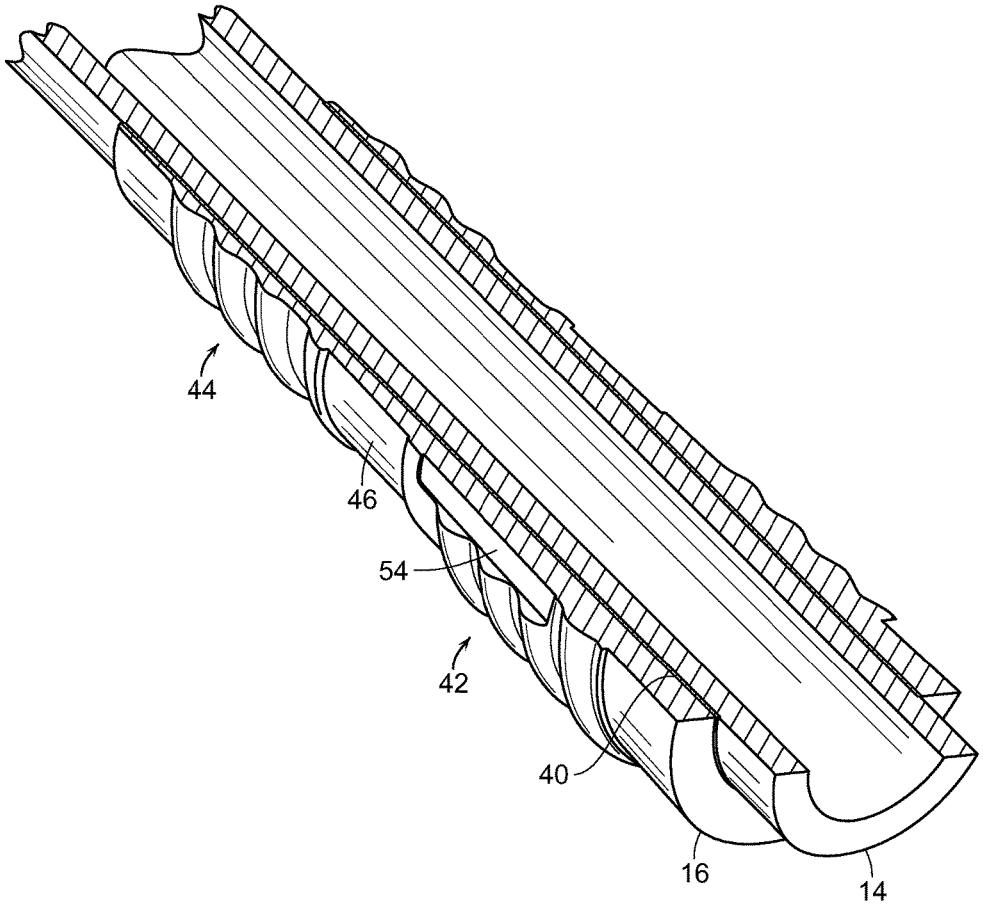
FIG. 5 is a cross-sectional view of the handle and vibration absorber.

While the vibration absorber 16 could be affixed to the end 28 of the handle 14 by various means, in a particularly preferred embodiment, the vibration absorber 16 is molded onto the handle 14 as molding the vibration absorber 16 onto the handle 14 has been found to have many advantages. Molding the vibration absorber 16 onto the handle 14 provides manufacturing and cost benefits in that the steps of otherwise creating a vibration absorber as a separate unit and then having to attach the vibration absorber to the handle 14, and the complications and costs involved with such an approach are eliminated by molding the vibration absorber 16 directly onto the handle 14. Furthermore, it has been found by the inventors, as illustrated in FIG. 5, that when the vibration absorber 16 and handle 14 are comprised of certain types of materials, such as the handle 14 containing resin or the like as part of a laminate composite material, the boundary layer 40 between the handle 14 and the vibration absorber 16 fuse to one another, such as having a crossover of material from the handle 14 and/or vibration absorber 16 migrating into the material of the other component. The molding of the vibration absorber 16 onto the handle 14 has been found to provide a very strong and secure connection between these components, typically more so than using adhesive or other mechanical attachment means.

Instead of having a generally uniform outer diameter and configuration, as illustrated, the handle 14 could have different configurations so as to conform to an inner surface of the barrel 12 and/or secure the vibration absorber 16 thereto. For example, the handle 14 could have a configuration at an end thereof as disclosed in U.S. application Ser. No. 14/584,078, the contents of which are hereby incorporated by reference, wherein an end of the handle 14 is tapered and include sections sloped towards one another and defining a recess into which the vibration absorber would be molded onto. The handle could include projections extending therefrom which would be embedded into the vibration absorber which could serve various purposes, including fixing the vibration absorber in place and preventing rotation. Such projections or configuration of the handle could also form shoulders or stops abutting the vibration absorber and prevent axial movement.

With reference now to FIGS. 3-6, the vibration absorber defines a first locking section 42 and a second locking section 44 spaced apart from the first locking section 42. A circumferential gap 46 is disposed between the first and second locking sections 42 and 44. The first and second locking sections 42 and 44 each include projections extending therefrom 48 and 50. The projections 48 and 50 may comprise threads formed on an outer surface of the first and second locking sections 42 and 44. The circumferential gap 46 defines an area between the first and second locking sections 42 and 44 so that the threads or projections 48 and 50 are non-continuous and the first and second locking sections 42 and 44 are spaced from one another and distinct from one another. As illustrated, the circumferential gap 46 may comprise a generally open-faced groove or non-threaded area between the first and second locking sections 42 and 44.

The vibration absorber 16 may also include other areas which are free of projections or threads, such as the area 52 at the end of the vibration absorber 16 adjacent to the end 28 of handle 14. The vibration absorber 16 also typically includes one or more channels 54 which are formed through the projections or threads 48 of the first locking section. The one or more channels 54 are formed generally along a longitudinal axis of the handle 14 so as to effectively cut through the threads 48. The channel 54, as illustrated, is typically an elongated open-faced channel. The channel 54 is configured so as to reside within the first locking section 42 of the vibration absorber 16 while still permitting the projections or threads 48 of the first locking section 42 to engage with corresponding depressions formed on an inner surface of the barrel 12.

The method of installing the various components of the bat 10 will now be described. Adhesive 56 is applied to the vibration absorber 16, and particularly to the areas comprising the circumferential gap 46 and the one or more channels 54 so that the adhesive 56 resides therein. The circumferential gap 46 and channel 54 define areas having an outer diameter which may be less than the outer diameter of the threads or projections 48 and 50 of the first and second locking sections 42 and 44. In practice, the adhesive may be applied to the entire exterior surface of the vibration absorber 16 and/or an inner surface of the barrel 12, such as an area having depressions 58, defining internal threads, adjacent the proximal end 20 of the barrel 12.

Figure 6:
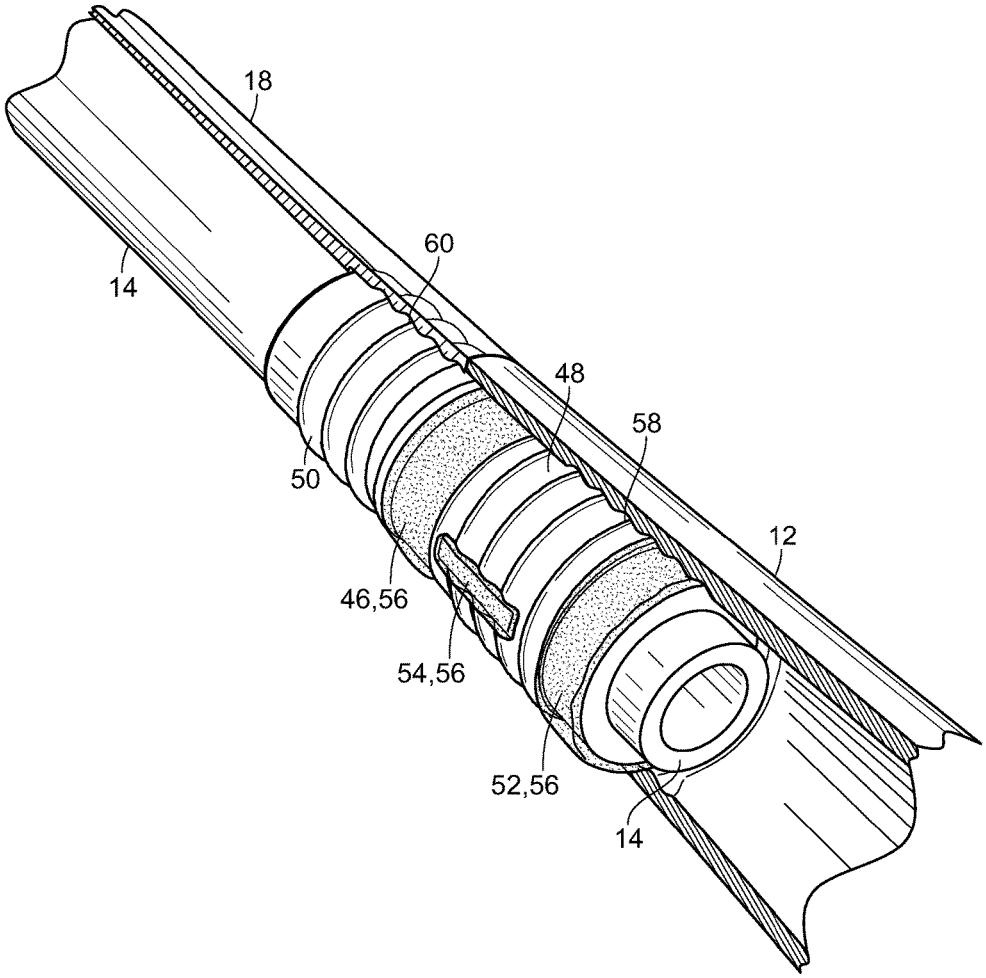
FIG. 6 is a partially sectioned and perspective view illustrating the handle attached to a barrel of the bat by means of threaded connection and adhesion of the vibration absorber to an inner surface of the barrel and a sleeve disposed over the handle and a lower locking section of the vibration absorber.
Figure 7:
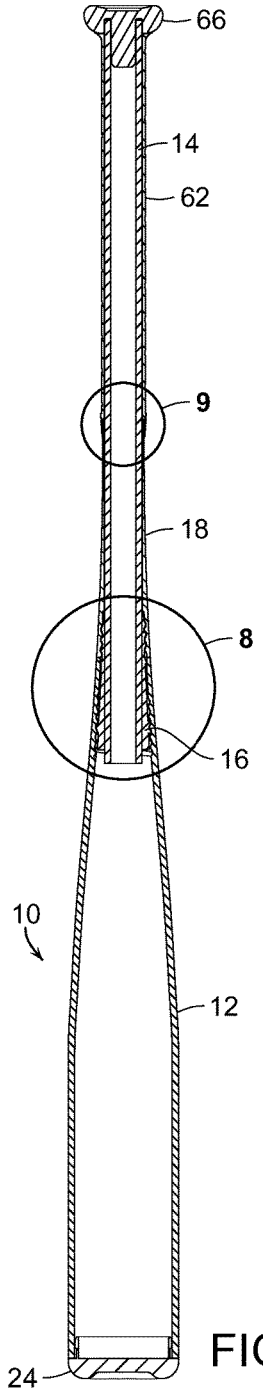
FIG. 7 is a cross-sectional view of the bat of the present invention.
Figure 8:
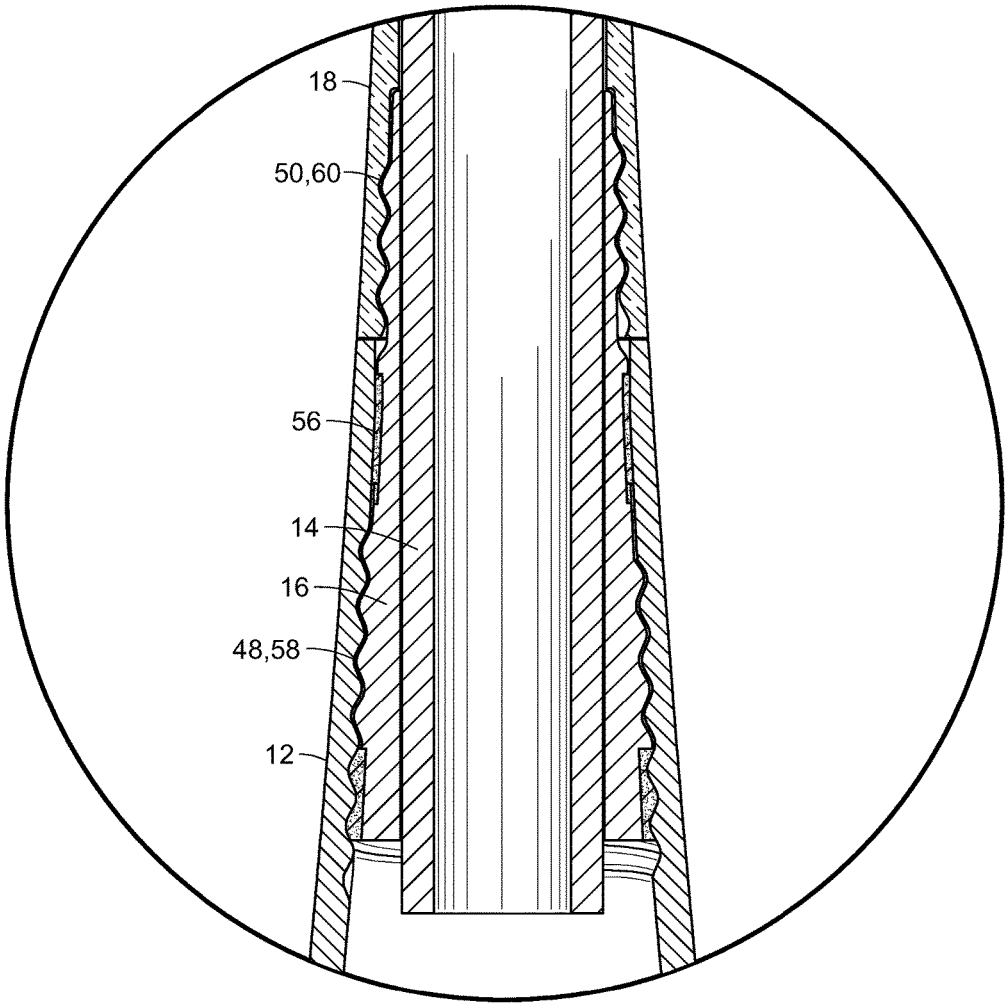
FIG. 8 is an enlarged cross-sectional view of area "8" of FIG. 7, illustrating the interconnection of a sleeve and barrel to a vibration absorber of the bat.

The first end 26 of the handle is inserted through the opening of the distal end 22 of the barrel 12 and the handle 14 is pulled through the barrel 12 until the vibration absorber 16 engages the inner surface of the barrel which is typically tapered adjacent to the proximal end 20 thereof. As illustrated in FIGS. 6 and 8, the projections 48 of the first locking section 42 are engaged with the depressions 58 formed on the inner surface of the barrel 12 so as to attach the vibration absorber 16, and thus the handle 14, to the barrel 12. More particularly, in the illustrated embodiment, the handle 14 is turned so that the external threads 48 of the first locking section 42 of the vibration absorber 16 are threadedly connected to the internal threads 58 formed on the inner surface of the barrel 12. This forms a direct mechanical connection which attaches and locks the handle 14 to the barrel 12.

Moreover, the adhesive 56 adheres the vibration absorber 16 to the barrel 12. Due to the threaded engagement between the threads 48 of the first locking member 42 and the internal threads 58 of the barrel 12, the adhesive may be forced out of the areas of threaded connection, or only a very thin layer of adhesive remain therebetween. This adhesive can crack and fail over time due to the stresses applied to those areas as the bat 10 hits a ball or other object. However, the adhesive 56 which is within the circumferential gap 46, channel 54 and other gaps and non-threaded areas 52 of the vibration absorber 16 is retained within those areas, may be of a greater thickness, and forms a strong adhesion between the vibration absorber 16 and the inner surface of the barrel 12. Thus, the vibration absorber 16, and thus the handle 14, is attached to the barrel 12 by both the threaded connection as well as the adhering of the vibration absorber 16 to the inner surface of the barrel 12, forming a durable and reliable attachment and connection over time.

As a ball or other object is hit by the barrel 12 of the bat 10, vibrations and shock forces caused by the impact will be transmitted down the length of the barrel 12 to the vibration absorber 16 which absorbs and dissipates the vibrations. Preferably, the exterior configuration of the vibration absorber 16, and particularly the first locking section 42, mates with and conforms to substantially all of the inner surface of the barrel 12 adjacent the proximal end 20 thereof. This forms a tight fit and secure attachment as well as effectively conveying the vibration forces to the vibration absorber 16. The adhesive 56 may be selected so that it is comprised of a material having shock absorbing characteristics, such as a polymeric material. In this manner, the adhesive 56 can also absorb and dissipate vibrations and shock forces resulting from the bat 10 hitting an object.

The sleeve 18 is inserted over the first end 26 of the handle 14 and brought into engagement with the second locking section 44 of the vibration absorber 16. The sleeve 18 is generally cylindrical and has an outward taper at an end thereof which engages the second locking section 44 of the vibration absorber 16. An end of the sleeve 18 includes depressions, typically in the form of internal threads 60, formed on an inner surface thereof which engage the projections or threads 50 formed on the second locking section 44, as illustrated in FIGS. 6 and 8. For example, the sleeve 18 may be rotated so that the internal threads 60 thereof are threadedly engaged with the external threads 50 of the second locking section 44 of vibration absorber 16.

The second locking section 44 of the vibration absorber 16 may extend outward of the barrel 12, as illustrated, such that the end of the sleeve 18 abuts the proximal end 20 of the barrel 12. The sleeve 18 may be comprised of a vibration dampening or dissipating material, such as silicone rubber or the like, so as to further attenuate and dampen and dissipate the vibration forces generated at the barrel 12 when the bat 10 hits a ball or other object. The sleeve 18 is preferably of a size and configuration such that its inner surface is in engagement with an outer surface of the handle 14, further serving to dissipate and dampen any vibrational forces which may be transmitted through the handle 14. The sleeve 18 may be translucent or transparent such that the connection between the sleeve 18 and the second locking section 44 is viewable, as illustrated in FIGS. 1 and 2. This provides a visible threaded locking mechanism, as well as contributing to a well-controlled flex under a bat to ball impact. The interconnection of the vibration absorber 16 and the barrel 12 also contributes to the well-controlled flex under a bat to ball impact.

Figure 9:
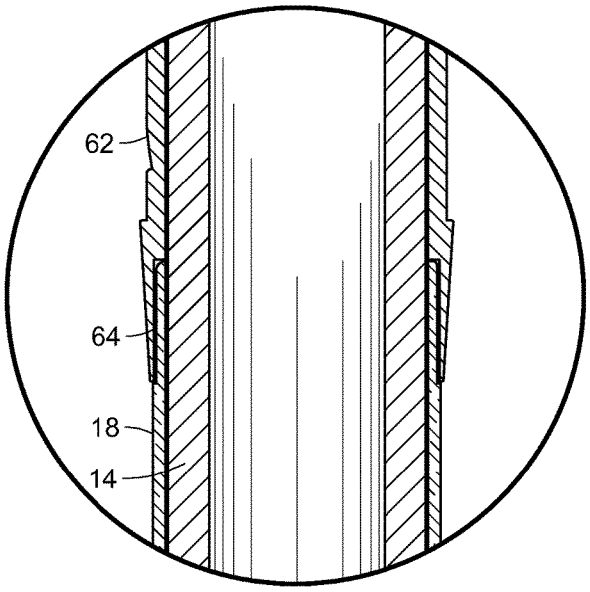
FIG. 9 is an enlarged cross-sectional view of area "9" illustrating a wrap and sleeve over a handle of the bat.

A grip 62 is typically placed over a grip portion of the handle 14. The grip 62 is typically comprised of a material which is comfortable to the user while providing a degree of friction or gripability so as to securely hold and swing the bat 10 in use. A portion of the grip 62 may overly a portion of the sleeve 18. For example, as illustrated in FIG. 9, an end of the grip 62 may define an outer lip 64 which is disposed over an end of the sleeve 18. The end of the sleeve may be of a reduced thickness to fit within the gap caused by the lip 62. The grip 62 may be adhered onto the handle 14 and/or the end of the sleeve 18 or have a frictional fit formed therebetween.

To complete the bat, a cap or plug 24 may be attached to the open distal end 22 of the barrel 12 and a knob 66 may be attached to the first end 26 of the handle 14. The knob 66 prevents the user's hands from slipping off the end of the bat 10 when swinging the bat.

In the assembled bat 10, the vibration absorber 16 adds two important features to the bat with important functions. In particular, the second locking section 44 provides the handle 14 a flex component allowing energy to be stored during the whip action of a batter's swing to be released at impact to provide greater batted-ball speed. The first locking section 42 between the handle 14 and the barrel provides a stiffener which increases the trampoline effect in the barrel 10 to be more effective when striking a ball, thus also improving batted-ball speed.

Although several embodiments have been described in detail for purposes of illustration, various modifications may be made without departing from the scope and spirit of the invention. Accordingly, the invention is not to be limited, except as by the appended claims.

What is claimed is:

1. A baseball or softball bat, comprising:

a barrel having a distal end and a proximal end;

a handle comprising a first end having a grip portion adjacent thereto and a second end disposed within the proximal end of the barrel;

a vibration absorber affixed to the second end of the handle comprised of a shock absorbing material, the vibration absorber defining a first locking section having projections which engage with depressions formed on an inner surface of the barrel adjacent the proximal end thereof, a second locking section spaced apart from the first locking section and defining projections, and a circumferential gap disposed between the first and second locking sections;

an adhesive disposed in the circumferential gap for adhering the vibration absorber to the barrel; and a sleeve disposed over the handle and having depressions formed on an inner surface at an end thereof that engage the projections of the second locking section.

2. The bat of claim 1, wherein the projections of the first locking section comprise threads that are threadedly attached to threads formed on the inner surface of the bat barrel.

3. The bat of claim 2, further comprising a channel formed through the threads of the first locking section generally along a longitudinal axis of the handle, wherein the adhesive is disposed in the channel to adhere the vibration absorber to the barrel.

4. The bat of claim 1 or 3, wherein the vibration absorber is comprised of an elastomeric material molded onto the second end of the handle.

5. The bat of claim 4, wherein the elastomeric material and the material of the handle are fused to one another as the vibration absorber is molded onto the handle.

6. The bat of claim 1 or 3, wherein the adhesive in the circumferential gap is comprised of a polymeric material having shock absorbing characteristics.

7. The bat of claim 3, wherein the adhesive in the channel is comprised of a polymeric material having shock absorbing characteristics.

8. The bat of claim 1, wherein the second locking section of the vibration absorber extends outward of the proximal end of the barrel.

9. The bat of claim 8, wherein the sleeve is comprised of a translucent or transparent material so that a connection between the sleeve and the second locking section is viewable.

10. The bat of claim 9, wherein the sleeve is comprised of a silicone rubber material.

11. The bat of claim 1, wherein the projections of the second locking section comprise threads that are threadedly attached to threads formed in the inner surface of the sleeve.

12. The bat of claim 1, wherein the handle is comprised of a composite material and the barrel is comprised of a composite material or metal.

13. The bat of claim 1, further comprising a grip placed over the grip portion of the handle and over at least a portion of the sleeve.

14. The bat of claim 1, further comprising a grip placed over the grip portion of the handle and over at least a portion of the sleeve.

15. A baseball or softball bat, comprising:

a barrel having a distal end and a proximal end and internal threads formed on an inner surface of the barrel adjacent the proximal end;

a handle comprising a first end having a grip portion adjacent thereto and a second end disposed within the proximal end of the barrel;

a vibration absorber affixed to the second end of the handle comprised of a shock absorbing material, the vibration absorber defining a first locking section having threads connected to the internal threads of the barrel, a second locking section spaced apart from the first locking section so as to extend outward of the proximal end of the barrel, a circumferential gap disposed between the first and second locking sections, and a channel formed through the threads of the first locking section generally along a longitudinal axis of the handle;

an adhesive disposed in the circumferential gap and the channel for adhering the vibration absorber to the barrel; and a sleeve disposed over the handle and having threads formed on an inner surface at an end thereof that engage threads of the second locking section.

16. The bat of claim 15, wherein the vibration absorber is comprised of an elastomeric material molded onto the second end of the handle.

17. The bat of claim 16, wherein the elastomeric material and the material of the handle are fused to one another as the vibration absorber is molded onto the handle.

18. The bat of claim 15, wherein the adhesive in the circumferential gap and channel is comprised of a polymeric material having shock absorbing characteristics.

19. The bat of claim 15, wherein the sleeve is comprised of a translucent or transparent material so that the connection between the sleeve and the second locking section is viewable.

20. The bat of claim 15, wherein the sleeve is comprised of a silicone rubber material.

21. The bat of claim 15, wherein the handle is comprised of a composite material and the barrel is comprised of a composite material or metal.

* * * * *